US005286008A

United States Patent [19]

de Haas et al.

[11] Patent Number: 5,286,008

[45] Date of Patent: Feb. 15, 1994

[54] SYSTEM FOR INERTING A CASTING VESSEL USED FOR TRANSPORTING MOLTEN METAL

[75] Inventors: Hans de Haas, Lilienthal-Klostermoor; Klaus Ulrich; Klaus Grützmacher, both of Bremen; Erhard Krause; Horstmar Mohnkern, both of Ritterhude; Manfred Löwenstein, Schiffdorf; Manfred Voss, Bremen; Joachim Witt, Ritterhude; Uwe Hammer, Bremen, all of Fed. Rep. of Germany

[73] Assignee: Klockner Stahl GmbH, Duisburg, Fed. Rep. of Germany

[21] Appl. No.: 861,873

[22] PCT Filed: Oct. 15, 1991

[86] PCT No.: PCT/DE91/00814

§ 371 Date: Oct. 29, 1992

§ 102(e) Date: Oct. 29, 1992

[87] PCT Pub. No.: WO92/07099

PCT Pub. Date: Apr. 30, 1992

[30] Foreign Application Priority Data

Oct. 20, 1990 [DE] Fed. Rep. of Germany ..... 4033482

[51] Int. Cl.[5] ..... C21C 1/06; C21B 7/14; B08B 15/02

[52] U.S. Cl. ..... 266/217; 266/143; 222/603

[58] Field of Search ..... 266/165, 143, 236, 158, 266/159, 216, 217; 222/603

[56] References Cited

U.S. PATENT DOCUMENTS

| | | | |
|---|---|---|---|
| 4,538,670 | 9/1985 | LaBate | 222/603 |
| 4,840,297 | 6/1989 | Weekly et al. | 222/603 |

FOREIGN PATENT DOCUMENTS

| | | | |
|---|---|---|---|
| 0071359 | 7/1982 | European Pat. Off. . | |
| 0383184 | 2/1990 | European Pat. Off. . | |
| 2632707 | 1/1978 | Fed. Rep. of Germany . | |
| 3903444 | 2/1990 | Fed. Rep. of Germany . | |
| 2506190 | 11/1982 | France | 222/603 |
| 0206559 | 9/1986 | Japan | 222/603 |

*Primary Examiner*—Scott Kastler

*Attorney, Agent, or Firm*—Watson, Cole, Grindle & Watson

[57] ABSTRACT

A system for inerting a casting vessel, such as a traversable ladle or torpedo vessel, used for transporting molten metal, the vessel being positioned below the molten metal outlet opening at a transfer station, and the vessel cavity being flushed with an inert gas both prior to the molten metal inletting and during the inflow of the molten metal in such a manner as to avoid contact between the molten metal surface and the vessel and the atomospheric oxygen. A blowpipe is arranged in the vicinity of the molten metal outlet opening but does not intersect the molten metal stream, is located outside the free space profile of the vessel at least during the approach and return of the vessel, and terminates a distance from the vessel inlet opening and produces at its terminal end an inert gas stream which enters the cavity of the vessel adjacent the molten metal stream at an acute angle.

8 Claims, 1 Drawing Sheet

SYSTEM FOR INERTING A CASTING VESSEL USED FOR TRANSPORTING MOLTEN METAL

BACKGROUND OF THE INVENTION

This invention relates to a system for inerting a casting vessel, such as a traversable ladle or torpedo vessel, used for transporting molten metal, the vessel being used when tapping a blast furnace. With the vessel positioned below the molten metal outlet opening at a transfer station, the vessel cavity is flushed with an inert gas both above the cavity inlet and during inflow of the molten metal into the vessel, in such a manner that contact between the molten metal surface in the vessel and the atmosphere is effectively prevented.

A related system of this type is disclosed in German Patent No. 39 03 444 in which inert gas is forced into the interior of the casting vessel through a flexible feed line in the vicinity of the vessel while positioned below the molten metal outlet opening at a transfer station. A disengageable coupling is attached to the casting vessel, and a stationary pipe is connected to that coupling on the outer surface of the vessel having a through opening in the wall thereof. Such openings are arranged to lie above the maximum molten metal level in the vessel and below the inlet opening of the casting vessel at its upper edge.

The drawback of such arrangement is that all casting vessels used for transporting molten metal in a metallurgical operation must be provided with an inlet opening or openings in the vessel wall thereof, such that special consideration must be taken with a realization that such openings must penetrate both the outer metal jacket and the conventional refractory lining of the casting vessel And, such openings are unusually made after the vessel finishing operation which is time consuming and uneconomical.

And, when a casting vessel is relined due to wear such openings which again need be made involve additional time-consuming treating operations.

Despite the care taken in the provision of such openings it is difficult to assure that the molten metal or slag will not flow into such openings and plug them despite the specified distance between the molten liquid level and the open end of the vessel. The plugging occurs while filling the vessel with molten metal and only leads to expensive maintenance work.

Moreover, the prior art system requires the coupling and uncoupling of the flexible inert gas feed line to or from the stationary pipe on the vessel which demands additional operations and care, normally carried out manually, can involve a complex operation especially when the casting vessel is Positioned below a casting platform since pressurization of the feed line with inert gas is controlled normally on or below the casting platform. Improper coupling and uncoupling and improper inert gas feed control can lead to serious damage to the entire system and to the undesired outflow of inert gas.

The aforementioned drawbacks result in added costs due to increased investment and maintenance, and results in added safety risks.

SUMMARY OF THE INVENTION

The present invention is intended to improve upon the prior art arrangement as aforedescribed, for inerting casting vessels used for transporting molten metal such that the inert gas outlet opening can be pressurized with inert gas via one or more permanently attached feed lines, and such pressurization can be made and monitored from a single specified location so as to minimize the investment and maintenance costs.

More particularly, the system according to the invention includes at least one inert gas blowpipe arranged in such manner in the vicinity of the molten metal outlet opening at a transfer station yet it does not intersect the stream of the inflowing molten metal. The blowpipe is located outside the free space profile of the casting vessel during the approach and return of the casting vessel at the transfer station, and the blowpipe terminates at a spaced distance from the cavity inlet through which the molten metal flows, and produces an inert gas stream at its free end facing the casting vessel which stream enters into the casting vessel cavity adjacent the stream of molten metal at an acute angle to the flow direction of the molten metal into the vessel.

It is especially advantageous for at least one inert gas blowpipe to be exposed in the vicinity of the molten metal outlet opening at the transfer station such that it cannot intersect the stream of inflowing molten metal, is located outside the free space profile of the casting vessel at least during the approach and return of the vessel, and terminates a distance from the vessel opening and produces at its free end facing the casting vessel an inert gas stream which enters the vessel cavity adjacent the incoming stream of molten metal at an acute angle to the vertical In such manner, instead of extensive and repeated refinishing operations required for a number of casting vessels, only a one-time installation of a suitable inert gas blowpipe arrangement in the vicinity of the molten metal outlet opening is required.

Due to the arrangement of each inert gas blowpipe outside the stream of molten metal no costly high melting materials but rather only economical and commercially available steel pipes are used, and no precautionary measures must be taken against any eventual expanding of the molten metal stream on sub-sections of the inert gas blowpipe.

Also, with such arrangement of each inert gas blowpipe outside the free space profile of the casting vessel, at least during the approach and return to the molten metal outlet opening, there is no need for additional manipulations involving safety risks at the vessels themselves, so that in the presence of a casting platform of a suitable shield between the vessel chamber of the feed lines of the molten metal to the transfer station and the chamber of the casting vessels it is possible to control and monitor the pressurization of the inert gas blowpipes with inert gas from only one of such chambers, preferably from that of the feed lines of the molten metal to the transfer station.

Moreover, with the present arrangement of each inert gas blowpipe which generates inert gas stream entering the vessel cavity at an acute angle to the vertical and adjacent the incoming stream of molten metal, induces in an advantageous manner the effect that it is possible to inert reliably at least for one suitable region of the acute angle and for one correspondingly suitable region of the inert gas entry between the molten metal stream and the wall of the casting vessel despite the spatial distance between the inert gas outlet opening on the blowpipe and the vessel cavity. Even one inert gas blowpipe can be adequate to ensure that the existing cavity of the vessel will be constantly filled with inert gas both upstream of its cavity inlet and during the inflow of the molten metal. And, the present arrangement has the advantage that each inert gas blowpipe can be provided with a permanently attached, stationary feadline arrangement to be controlled with known controllers such as valve arrangements since such feed line arrangements are easier to monitor and repair.

The inert gas blowpipes may be of invariable length resulting in especially low investment in maintenance costs while assuring adquate filling of the vessel cavity with the desired inert gas stream above the inlet opening of the casting vessel.

In accordance with another feature of the invention the inert gas blowpipe can be telescopic at least at its end section facing the casting vessel so that it can be extended and retracted relative to the casting vessel opening for permitting the gas stream to be inletted in a useful manner. Telescoping movement of the blowpipe can be controlled and monitored from a control room without the need for viewing the end of the blowpipe facing the casting vessel Another feature of the invention is that sound absorbers of known type may be attached to the ends of the inert gas blowpipes facing the respective casting vessels, such sound absorbers significantly reducing the noise level in the vicinity of the transfer station for the operators in that vicinity.

The inert gas blowpipes can be located in the inspection tubes provided on the casting platform for observing the molten liquid level in the vessel. Such an arrangement avoids the need for attaching additional lead throughs into the casting platform which thereby reduces cost and permits a continuous optical control of the inert gas blowpipe while carrying out of the requisite maintenance work on the blowpipes in an economical manner.

At least one other inert gas blowpipe which generates a back pressure may be stacked in the inspection tube with respect to the hot gases from the casting vessel, and which Projects into the casting stage-sided entry region of the inspection tube in such a manner as to protect the workmen on the casting platform against the hot gases which are normally occasioned by the back pressure in the inspection tube caused by compressed air. Such other blowpipe prevents the compressed air from flowing through the inspection tube into the opening area of the casting vessel and conveying oxygen to the molten metal in the casting vessel by causing turbulence with the vial of inert gas surrounding the molten metal stream, or with the inert gas stream from the blowpipe. Each additional blowpipe can be provided with a separately operable controller for ensuring a minimum of inert gas consumption with maximum reliability.

Suitable inert gases used in the present system may be nitrogen gas or the waste gases from the complete combustion of a suitable fuel, for example, natural gas or petroleum.

DETAILED DESCRIPTION OF THE INVENTION

Figure 1:
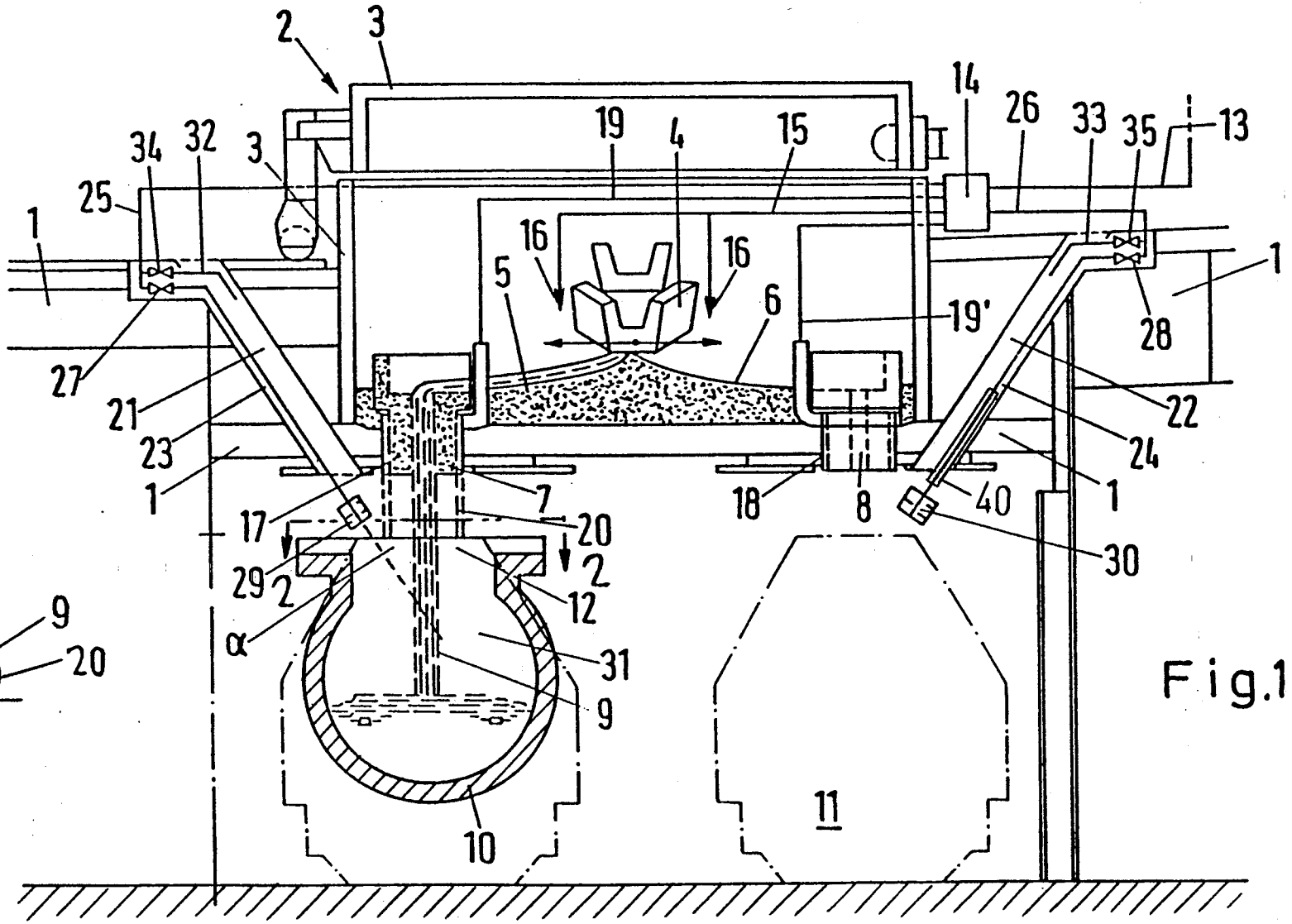
FIG. 1 is a schematic illustration, in vertical section, of a casting platform of a blast furnace at a transfer station incorporating the invention.
Figure 2:
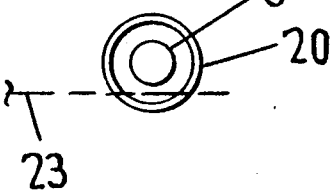
FIG. 2 is a view taken substantially along the line 2—2 of FIG. 1.

Turning now to the drawings wherein like reference characters refer to like and corresponding parts throughout the several views, a vertical sectional view of a casting platform 1 of a blast furnace has a transfer station 2 which is arranged in a depression of the casting platform and substantially comprises a two-part, substantially gas-tight housing 3 supported on the casting platform with its upper section designed as a movable cover. A swivel chute 4 which is connected to transport chutes (not shown) on the casting platform has distribution chutes 5, 6 and molten metal outlet openings 7, 8. The transfer station delivers a stream 9 of molten metal via the swivel chute alternately into casting vessels 10 and 11, which may comprise, for example, movable ladles or torpedo vessels disposed with their openings 12 below outlet openings 7, 8. To avoid metal oxides and other oxides from being produced on the surface of the molten metal, the interior of the transfer station 2 is pressurized with an inert gas, for example nitrogen or the waste gas from the complete combustion of natural gas or petroleum, by means of a main feed pipe 13, a distributor station 14, a feed pipe 15 and an outlet nozzle 16, whereby the swivel chute can be cooled at the same time. Outlet opening 7, 8 is also provided with annular nozzles 17, 18 which are pressurized with inert gas via feed lines 19, 19' during the process of delivering molten metal to the casting vessel, thus forming a tubular inert gas veil 20 surrounding stream 9, the veil extending from outlet opening 7 at least as far as opening 12 of vessel 10.

Also, to prevent metal or other oxides from forming on the surface of the molten metal in the interior of the casting vessels, including the lower end of stream 9, elongated inert gas blowpipes 23, 24 are disposed in inspection tubes 21, 22 mounted on casting platform 1. Each inert gas blowpipe is pressurized with inert gas via feed pipes 25, 26 from distributor station 14 as controlled and regulated by known valve arrangements 27, 28 which are located outside the inspection tubes. On the end of each inert gas blowpipe 23, 24 facing casting vessel 10, 11 the inert gas exits through a known sound absorber 29, 30 as a directed stream which enters cavity 31 of the casting vessels 10, 11 adjacent stream 9 of the molten metal. The blowpipes are disposed at a predetermined angle $\alpha$ relative to the vertical central axis of the casting vessel, which angle is greater than 0° and less than a right angle. The inert gas from the blowpipe displaces or wards off the atmospheric oxygen from cavity 31 such that the displacement of the atmospheric oxygen is introduced into the casting vessel before the inletting of the molten metal into the vessel.

And, a section 40 of each blowpipe can be telescopic for extending and retracting the blowpipe relative to inlet opening 12. The telescoping movement can be controlled and monitored from a control room (not showm).

The use of sound absorbers 29, 30 is also a protective measure which can be effected in a simple manner together with the use of inert gas blowpipes 23, 24 to the benefit of the operators working in the vicinity of the transfer station. Another benefit to the workmen is the provision of second, short inert gas blowpipes 32, 33 located at the casting platform-sided entry regions of the inspection tubes which are also pressurized with inert gas by distributor station 14 via feed pipes 25, 26 which can be controlled and regulated by separate valve arrangements 34, 35 independently of the inert gas blowpipes 23, 24. Normally, the second blowpipes 32, 33 supply inert gas during the entire operating period of the transfer station for delivering inert gas into the ends of the inspection tubes facing away from the casting vessels in order to generate in them adequate back pressure to prevent a stack affect of the inspection tubes with respect to the hot gases from the casting vessels or from their environment, which otherwise can give rise to a safety risk for the operators working on the casting platform. Elimination of such build up of back pressure avoids the risk that in some manner additional oxygen-containing gas mixture, for example, compressed air, enters the opening region of each casting vessel and transmits oxygen into the molten metal in the casting vessel by means of turbulence with the inert gas veil 20 surrounding the molten metal stream, or by means of turbulence with the inert gas stream generated by the inert gas blowpipes 23, 24.

In particular nitrogen or the waste gases from the complete combustion of natural gas or petroleum can be used as the inert gas for the present invention which, of course, is not limited to the illustrated embodiment.

What is claimed is:

1. A system for inerting a casting vessel used for transporting molten metal, the vessel, for use when tapping a blast furnace, having an uncovered inlet opening and an internal cavity, the system including a gas-tight housing at a transfer station having a molten metal outlet opening below which the casting vessel is located, the vessel being movable into and out of the transfer station, means for pressurizing the cavity of the vessel with inert gas during the delivery of molten metal into the cavity of the vessel, a first inert gas blowpipe located in the vicinity of said outlet opening and out of the path of movement of the vessel into and out of the transfer station, the blowpipe extending toward the vessel inlet opening and terminating a predetermined distance from the vessel, the blowpipe being fixed to the housing and extending at an acute angle to the central axis of the inlet opening and being laterally spaced from said axis for delivering an inert gas stream to the internal cavity of the vessel without intersection the flow of molten metal through the vessel inlet opening and into he vessel cavity, whereby any contact between the surface of the molten metal in the vessel and the atmosphere is effectively prevented.

2. The device for inerting casting vessels, as claimed in claim 1, wherein the blowpipe has a fixed length.

3. The device for inerting casting vessels, as claimed in claim 1, wherein the blowpipe has a sound absorber mounted on the terminal end thereof facing the vessel.

4. The device for inerting casting vessels, as claimed in claim 1, wherein the blowpipe comprises a telescopic pipe which is extendable and retractable relative to the inlet opening of the vessel.

5. The device for inerting casting vessels, as claimed in claim 1, further comprising a casting platform in which the housing is supported, a hollow inspection tube extending through the platform toward the inlet opening of the vessel for observing the molten metal level in the vessel, the blowpipe extending through the inspection tube beyond the free end thereof.

6. The device for inerting casting vessels, as claimed in claim 5, further comprising a second inert gas blowpipe which serves to generate a back presure and which projects into an open end of the tube oposite said free end thereof.

7. The device for inerting casting vessels, as claimed in claim 6, further comprising feed line means for conveying inert gas to said first and second blowpipes, said feed line means including inert gas distributor means and separately operable control means for valving inert gas to each of said below pipes.

8. The device for inerting casting vessels, as claimed in claim 7, wherein said feed line means, said distributor means and said control means are located above the casting platform.

* * * * *